United States Patent [19]

Bratt

[11] 4,249,728

[45] Feb. 10, 1981

[54] TENNIS RACKET EXERCISE WEIGHT ASSEMBLY

[76] Inventor: Richard L. Bratt, 31 Laurel Hill La., Holden, Mass. 01520

[21] Appl. No.: 4,658

[22] Filed: Jan. 19, 1979

Related U.S. Application Data

[63] Continuation of Ser. No. 763,532, Jan. 28, 1977, abandoned.

[51] Int. Cl.[3] ..... A63B 69/38

[52] U.S. Cl. ..... 273/29 A

[58] Field of Search ..... 273/29 A, 73 R, 73 C, 273/74, 26 B, 194 R, 194 A, 194 B; 150/52 G

[56] References Cited

U.S. PATENT DOCUMENTS

| | | | |
|---|---|---|---|
| D. 231,150 | 2/1974 | Berry | 273/74 X |
| 3,330,560 | 7/1967 | Higdon | 273/73 R |
| 3,351,346 | 11/1967 | Strahan | 273/26 B X |
| 3,398,961 | 8/1968 | Higdon | 273/194 B X |
| 3,414,260 | 12/1968 | Gust | 273/29 A X |
| 3,809,397 | 5/1974 | Gruenewald | 273/26 B |
| 3,874,666 | 4/1975 | Ross | 273/73 R |
| 3,943,989 | 3/1976 | Sperling | 273/74 X |
| 3,997,159 | 12/1976 | Malhas | 273/29 A |

FOREIGN PATENT DOCUMENTS

| | | | |
|---|---|---|---|
| 1376724 | 9/1964 | France | 273/73 C |

OTHER PUBLICATIONS

"The Sporting Goods Dealer"; May 1975; p. 146.

*Primary Examiner*—Richard J. Apley
*Attorney, Agent, or Firm*—Lewis M. Smith, Jr.

[57] ABSTRACT

A tennis racket exercise weight assembly, readily secured to and removed from the strings traversing the head of a cooperating tennis racket, opposing elements of which are clamped to a racket for use to assist in developing the particular muscles required to hold and swing a tennis racket in the manner in which the racket is used in playing the game of tennis and particularly useful in combination with a cooperating tennis racket with its head and the exercise weight assembly clamped thereto enclosed within a correspondingly shaped closely fitted substantially air impervious racket cover of the conventional well-known type.

1 Claim, 2 Drawing Figures

TENNIS RACKET EXERCISE WEIGHT ASSEMBLY

CONTINUING APPLICATION

This is a continuing application based upon and claiming the filing date of United States patent application Ser. No. 763,532, filed Jan. 28, 1977, now abandoned.

FIELD OF INVENTION

The present invention is one of the class of athletic training devices designed to be connected to and thereby add weight to a hand held device for striking a ball, and especially for use in association with a tennis racket for the purpose of developing the strength and dexterity of a tennis player.

BACKGROUND OF THE INVENTION

The class of athletic training devices arranged to be mounted upon or connected to a hand held device for striking a ball in the course of a game, such as a bat used in baseball or a racket used in tennis, includes several prior art patents, as follows:

First, Mogren U.S. Pat. No. 2,134,451 disclosing an exercising device including a suspended weight connected to a cooperating hand held bat or tennis racket connected yieldably to the suspended weight by a flexible member or cable passed over a supporting pulley;

Second, Peterson U.S. Pat. No. 3,913,911 disclosing the combination of a tennis racket and selectively detachable weights mounted on opposite outside edges of the head of a tennis racket for use in play and providing modified weight and balance of a tennis racket so equipped;

Third, Moreland U.S. Pat. No. 3,907,292 disclosing a tennis racket provided with a curved hollow tube attached symmetrically to the outer edge of the frame of the head portion thereof enclosing two sets of weights respectively coacting with a pair of opposed spring members, in order to combine the properties of a "light" and a "heavy" racket in a single racket by shifting the weights longitudinally of the racket in response to the application of centrifugal force thereto as the racket is swung by a player. This configuration of spring resisted weights is so arranged and functions in such a manner as to be compatible with the employment of a racket so equipped either for exercise or in play;

Fourth, Latham et al U.S. Pat. No. 3,625,512 disclosing a racket including a frame made from an aluminum extrusion of a particular cross-section especially well suited to its use in a racket, also including provisions for mounting and enclosing weights selectively added to and fixedly secured to the outer surface of the extruded frame forming the peripheral portion of the head of a tennis racket; and Fifth, Ross U.S. Pat. No. 3,874,666 disclosing an accessory device for attachment to a racket, comprising a pair of opposing elements interconnected through and clamped in engagement with the opposite surfaces of the interwoven strings traversing the head portion of a racket. While the manner of mounting this accessory device upon the head portion of a racket generally resembles the manner of attaching the exercise weight assembly disclosed herein to a tennis or other racket, its surface its shape, its shown location on the head portion of a racket, and its purpose are all profoundly different from the purpose of the exercise weight assembly of the present invention.

The first four patents preferred to above share in common an express reference in each to a suitable provision, consistent with the particular structure described and illustrated in each, for selectively adjusting the amount of weight operative to constrain the movement of a tennis or other racket as it is swung by a player either in exercise or in play.

BRIEF DESCRIPTION OF THE INVENTION

The present invention features an exercise weight assembly comprising opposing weighted elements constructed and arranged to be quickly and easily engaged with and removed from the opposite sides of the interwoven strings extending transversely of the head portion of a tennis racket, and meanwhile to be secured fixedly in clamping engagement with the opposite faces of the coacting interwoven strings by a suitable quick release attachment means interconnecting the mutually opposed weighted elements.

The exercise weight assembly described and illustrated herein is designed to function not only with a tennis racket along, but also with a tennis racket with its head portion encased in a protective cover therefor comprising a pocket of the proper shape and size to fit closely over the head portion of the tennis racket and usually made from a flexible material relatively resistant to the passage of air therethrough, for reasons more fully described below.

More particularly, the respective opposite side surfaces of the exercise weight assembly are each preferably substantially planar and respectively substantially coplanar with the opposite sides of the head portion of the cooperating tennis racket, both as shown in FIG. 2 of the drawing, in order to most conveniently accommodate the selective use of a snugly fitted substantially air impervious cover for the head portion of a tennis racket in combination with the tennis racket and the inventive exercise weight assembly clamped to the head portion of the tennis racket in any desired location thereon, also as shown in FIG. 2.

BRIEF DESCRIPTION OF THE DRAWING

Referring now to the drawing, wherein like or corresponding reference numerals identify like or corresponding parts of the inventive device illustrated therein, the showing in each of the respective figures may be described briefly as follows.

DETAILED DESCRIPTION OF THE PREFERRED EMBODIMENT

Figure 1:
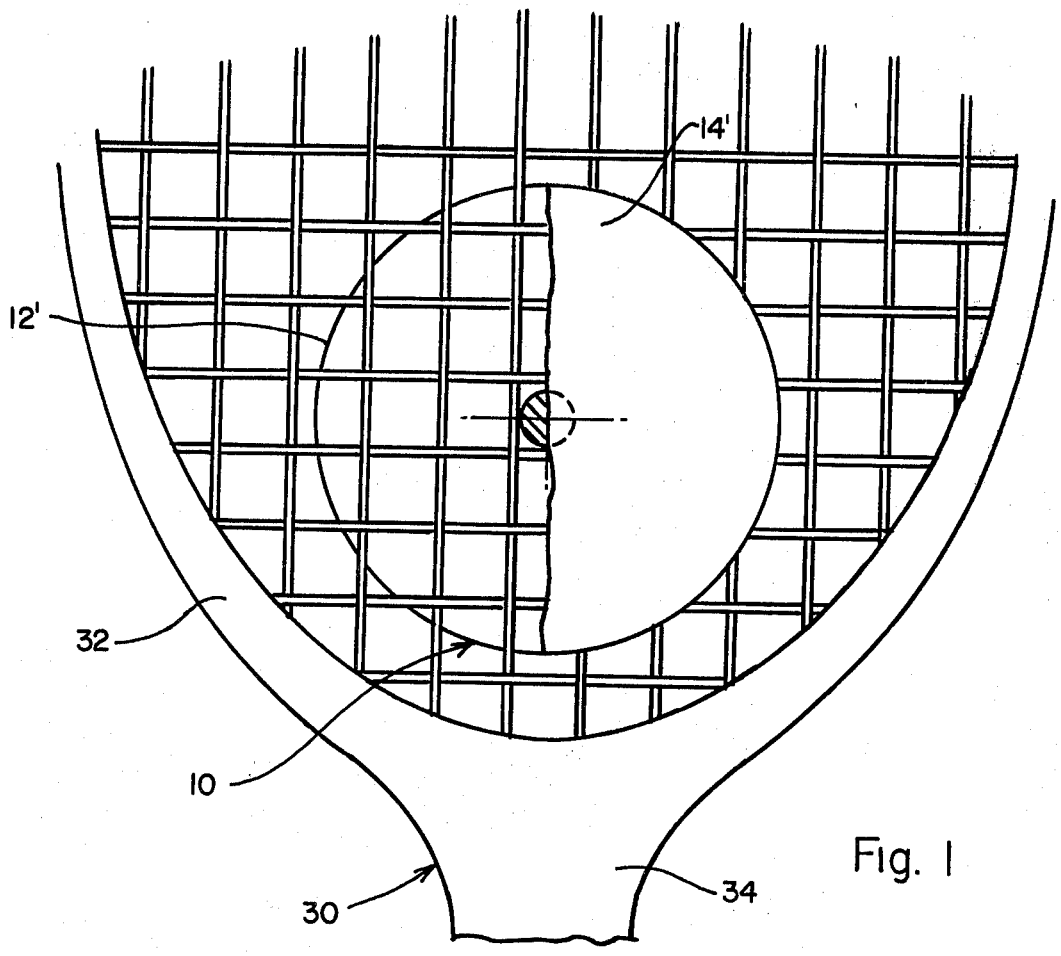
FIG. 1 is a plan view of one opposed outer face of the preferred embodiment of the exercise weight assembly of the instant invention, shown in a suitable operative relation to the head portion of a cooperating tennis racket.

The preferred embodiment of the invention consists of an exercise weight assembly generally designated by reference numeral 10 comprising first and second weight elements 12' and 12" and respectively having opposed planar outer faces 14' and 14", right cylindrical side surfaces 16' and 16", and opposed planar inner faces 18' and 18".

The respective weight elements 12' and 12" have concentric central cylindrical openings 22' and 22" at least part way therethrough from inner faces 18" each threaded fof engagement with the external threads of a stud 24 preferably fixedly secured within weight element 12' or 12" by application thereto of a suitable epoxy or other adhesive or otherwise in any satisfactory manner.

Experience to date suggests that exercise weight assemblies manufactured as described above conveniently may be made in one pound and one and a half pound weights, either with weight elements 12' and 12" each weighing one half pound, or with weight elements 12' and 12" each weighing three quarters of a pound. A player provided with both one and one and a half pound exercise weight assemblies may optionally combine one weight element of each weight to form an exercise weight assembly weighing one and a quarter pounds. Obviously, the illustrated exercise weight assembly may be made in other sizes, shapes, proportions, and weights and from different materials of suitable types and different unit weights.

OPERATION OF THE PREFERRED EMBODIMENT

A tennis player may use the exercise weight assembly described and illustrated herein, either with a cooperating tennis racket alone or with a cover over its head portion to perform exercises conceived and performed as often as necessary to improve the strength and control of the muscles the tennis player uses to swing a tennis racket, or with a cooperating tennis racket alone or with a cover over its head portion to perform suitable swinging motions with the tennis racket in order to limber up and otherwise prepare for a tennis match.

When the exercise weight assembly is attached in the manner shown and described to the strings traversing the head portion of a cooperating tennis racket alone, a swinging motion of the tennis racket corresponding to any one or more of the many swinging motions normally employed during a tennis game will produce additional centrifugal force upon the arm of an exercising tennis player due to the added weight of the exercise weight assembly, and additional inertial forces due to the same added weight on the tennis player's arm as each swinging movement or stroke is started and completed.

When the same process is repeated with the cover in place over the head portion of the tennis racket the forces produced by the additional weight of the exercise weight assembly attached to the cooperating tennis racket are the same, and, in addition, as the rate of the swinging motion of the racket first increases and then decreases during each swinging movement the restraint on the racket produced by drag on the cover first increases and then decreases as a direct function of the varying rate of the swinging movement, while the restraint on the racket due to the inertial effect of the exercise weight assembly starts high, decreases with decreasing acceleration and then increases with increasing deceleration as an inverse function of the rate of the swinging movement, and ends high.

Consequently, when both the exercise weight assembly and the cover are mounted in operative relation to the head portion of the tennis racket, the constraint upon the tennis racket opposing its swinging movement remains more nearly uniform throughout the stroke.

In addition, the locus of the exercise weight assembly relative to the head portion of a cooperating tennis racket may be shifted from time to time to suit the wishes and/or needs of each tennis player. For example, the respective weight elements 12' and 12" may be mounted in different positions along the longitudinal central axis of the head portion of the tennis racket to modify the moment of inertia acting upon the tennis racket produced by the addition of the exercise weight assembly thereto. Moreover, when a player is having difficulty positioning the racket properly angularly about its longitudinal axis during any type of stroke, the exercise weight assembly may also be positioned laterally relative to the longitudinal axis of the tennis racket by an amount sufficient to produce a suitable corrective torque about the longitudinal axis during each stroke.

Figure 2:
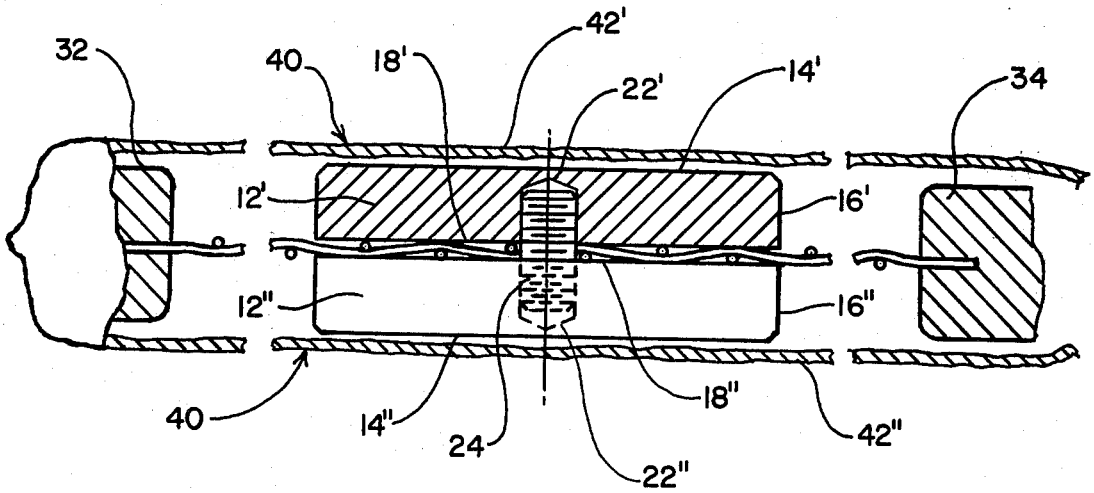
FIG. 2 is a side elevation of the preferred embodiment of the exercise weight assembly, partially broken away, shown in operative clamping engagement with the opposite faces of the interwoven strings traversing the head portion of the tennis racket, and extended to include broken away portions of a transverse section through the outer end of the frame for the head portion and through the neck portion of the tennis racket to which the opposite inner ends of the frame are connected and through the opposite sides of a conventional cover closely enclosing and protecting the head portion of the tennis racket.

In whichever position it is located on the head portion of the tennis racket the preferred embodiment of the exercise weight assembly generally designated by reference numeral 10 in FIG. 1 and shown in side elevation in FIG. 2 fits easily within a conventional tennis racket cover generally designated by reference numeral 40 in FIG. 2, consisting of first and second side portions, 42' and 42" respectively, each side portion being made of flexible sheet material and slightly larger than and conforming to the peripheral outline of the head portion of the tennis racket, and each side portion having its peripheral edge attached to the peripheral edge of the other side portion by stitching, adhesive or other suitable means and a releasable closure portion such as a slide fastener.

SUMMARY

The preferred embodiment of the exercise weight assembly of the instant invention described and illustrated herein can be used either alone in combination with a cooperating tennis racket, or together with a cover enclosing the head portion of the cooperating tennis racket, so that a tennis player swinging the tennis racket so equipped can improve the strength and the dexterity of the arm or arms with which he swings the racket.

In addition, in order to reduce or eliminate the relative rotating movement of the weight elements 12' and 12" as they are engaged and disengaged, the respective recesses 22' and 22" and the threaded stud 24 may be replaced by cooperating surfaces on the respective weight elements together forming a bayonet joint engaged and disengaged by relatively limited relative rotary motion, or by a central opening through one weight element and a member projecting from the other weight element having spring biased portions engaging coacting portions of the side wall of the central opening to maintain the respective weight elements in clamping engagement with the opposite faces of the crossed interwoven strings, until sufficient force is applied by hand through the exposed end of the central opening in one weight element and against the exposed outer end of the member projecting from the other weight element to disengage the respective weight elements from each other, without any relative rotary motion thereof.

What is claimed is:

1. A selectively weighted and air restrained tennis racket assembly for practice strokes comprising, in combination, a tennis racket with a relatively enlarged eliptical head portion supporting first and second spaced series of crossed interwoven strings under tension and a relatively reduced elongated handle portion attached to and supporting the head portion, a tennis racket head portion cover made of relatively air impervious flexible material forming first and second side sections thereof of the size and shape required and mutually interconnected so as to enclose the periphery and the opposite sides of the head portion of the tennis racket and to releasably secure the tennis racket cover to the head portion of the tennis racket, and an exercise weight assembly including first and second opposed coacting weight elements selectively located lengthwise and transversely of the head portion of said tennis racket and disposed on opposite sides of the crossed interwoven strings and mutually interconnected, said first and said second coacting weight elements respectively including first and second coacting locking surfaces selectively releasably mutually interengaged so as to maintain the first and second weight elements in clamping engagement with the opposite sides of the crossed interwoven strings, and respectively including first and second opposite side surfaces each substantially planar and respectively substantially coplanar with the first and second opposite sides of the head portion of said tennis racket, so as to fit readily within the cover for the head portion of said tennis racket in any selected position lengthwise and transversely of the head portion of the tennis racket, and so as to support and thereby stabilize a substantial central area of the side section of the head portion cover resistant to ambient air pressure during swinging movement of said tennis racket, whereby the restraint upon the swinging movement of said tennis racket assembly during each practice stroke remains more nearly constant throughout the stroke, because the restraint on the tennis racket due to the inertial effect of the exercise weight assembly starts high, decreases with decreasing acceleration, and then increases again with increasing deceleration, and ends high, as an inverse function of the varying rate of the swinging movement, while the restraint on the tennis racket produced by air drag on the head portion cover first increases from zero to a maximum and then decreases to zero again as a direct function of the varying rate of the swinging movement during the same practice stroke, so the forces constraining movement of the tennis racket throughout the practice stroke remain more nearly constant, when both the exercise weight assembly and the cover are mounted in operative relation to the head portion of the tennis racket.

* * * * *